US012774591B2

(12) United States Patent
Ni et al.

(10) Patent No.: US 12,774,591 B2
(45) Date of Patent: Oct. 27, 2026

(54) TUBE SUPPORT ASSEMBLY CAPABLE OF ARBITRARY ADJUSTMENT

(71) Applicant: XIAMEN DELMEI SANITARY WARE CO., LTD., Xiamen (CN)

(72) Inventors: Changzheng Ni, Xiamen (CN); Chunhua Wang, Xiamen (CN); Yongqiang Yan, Fuzhou (CN); Xingfa Liao, Xiamen (CN)

(73) Assignee: XIAMEN DELMEI SANITARY WARE CO., LTD., Xiamen (CN)

( * ) Notice: Subject to any disclaimer, the term of this patent is extended or adjusted under 35 U.S.C. 154(b) by 702 days.

(21) Appl. No.: 17/941,010

(22) Filed: Sep. 8, 2022

(65) Prior Publication Data

US 2024/0003125 A1 Jan. 4, 2024

(30) Foreign Application Priority Data

Jul. 4, 2022 (CN) ..... 202221704933.5

(51) Int. Cl.
*E03C 1/02* (2006.01)
*E03C 1/04* (2006.01)

(52) U.S. Cl.
CPC ..... *E03C 1/023* (2013.01); *E03C 1/0408* (2013.01)

(58) Field of Classification Search
CPC ..... E03C 1/023; E03C 1/0408
USPC ..... 4/601
See application file for complete search history.

(56) References Cited

U.S. PATENT DOCUMENTS 1,354,838 A * 10/1920 Perkins ..... A47K 3/28 239/587.5
1,758,115 A * 5/1930 Kelly ..... E03C 1/06 239/536
4,752,975 A * 6/1988 Yates ..... E03C 1/06 239/443
4,901,927 A * 2/1990 Valdivia ..... E03C 1/0408 4/596
2009/0265848 A1* 10/2009 Tsai ..... E03C 1/06 4/615
2014/0076445 A1* 3/2014 Zhou ..... F16L 27/047 137/874
2019/0366356 A1* 12/2019 Yu ..... E03C 1/0408
2023/0040613 A1* 2/2023 Yu ..... E03C 1/0408
2023/0086368 A1* 3/2023 Miller ..... B05B 15/63 239/280

* cited by examiner

*Primary Examiner* — Huyen D Le

(57) ABSTRACT

The present disclosure provides a tube support assembly capable of arbitrary adjustment, which includes a valve seat assembly. The valve seat assembly has a water inlet and at least two water outlets, the water outlets are respectively connected to a water outlet component, and the valve seat assembly is switchable to selectively connect the water inlet with any of the water outlet component; one of the water outlets is provided with a steering structure, and the steering structure enables the water outlet component connected to the steering structure to be adjusted at any angle and/or in any direction. Such humanized design can meet the shower requirements of most people with a simple and ingenious structure and good operability.

5 Claims, 3 Drawing Sheets

TUBE SUPPORT ASSEMBLY CAPABLE OF ARBITRARY ADJUSTMENT

CROSS-REFERENCE TO RELATED APPLICATIONS

This application is based upon and claims priority to Chinese Patent Application No. 202221704933.5, filed on Jul. 4, 2022, the entire content of which is incorporated herein by reference.

TECHNICAL FIELD

The present disclosure relates to the technical field of sanitary products, in particular to a tube support assembly capable of arbitrary adjustment.

BACKGROUND

The existing shower devices generally have fixed spray angle and direction which cannot meet the requirements of users who want to adjust the spray height and spray position. Even though some of the commercially available top showers allow the user to adjust the spray angle, the adjustment range is always limited and can hardly meet users' needs.

SUMMARY OF THE DISCLOSURE

In order to address the above problems, the present disclosure provides a tube support assembly capable of arbitrary adjustment.

To achieve the above objective, the present disclosure provides the following solutions.

A tube support assembly capable of arbitrary adjustment includes a valve seat assembly, the valve seat assembly has a water inlet and at least two water outlets, the water outlets are respectively connected to a water outlet component, and the valve seat assembly is switchable to selectively connect the water inlet with any of the water outlet component; one of the water outlets is provided with a steering structure, and the steering structure enables the water outlet component connected to the steering structure to be adjusted at any angle and/or in any direction.

Preferably, the steering structure includes a rotation cavity provided in the water outlet, a steering head provided in the rotation cavity, and a nut covered and connected to the steering head, the nut fixes the steering head in the rotation cavity, while ensures that the steering head is movable.

Preferably, a spherical arc surface is provided in the rotation cavity, an end of the steering head close to the rotation cavity is provided with a spherical head, and the spherical head is accommodated in the spherical arc surface, so that the steering head can be adjusted at any angle and/or any direction relative to the rotation cavity.

Preferably, a sealing component is provided between the spherical head and the spherical arc surface.

Preferably, a central axis of the rotation cavity and a central axis of the tube support assembly extend in an upward inclined direction.

Preferably, two water outlets are provided including a first water outlet and a second water outlet, a central axis of the second water outlet extends in the same direction of the central axis of the tube support assembly, and a central axis of the first water outlet and the central axis of the second water outlet form an angle.

Preferably, the angle formed between the central axis of the first water outlet and the central axis of the second water outlet is an obtuse angle.

Preferably, an end of the steering head away from the rotation cavity is provided with a connection part, the connection part is connected to a first end of a second water outlet tube, a second end of the second water outlet tube is connected to a top shower, the second water outlet tube causes the top shower to be rotated at any angle and/or in any direction relative to the valve seat assembly.

Preferably, the first water outlet is connected to the steering head, the second water outlet is downwardly connected to a first end of a first water outlet tube, and a second end of the first water outlet tube is successively connected to a hose and a hand shower.

Preferably, the water inlet of the valve seat assembly is connected to a water inlet tube, and the water inlet tube is connected to a water supply.

The present disclosure has the following advantages.

1) By setting the steering structure at the water outlet connected to the top shower, the top shower and the water outlet tube connected with the top shower can be rotated at any angle and in any direction relative to the valve seat assembly. Such humanized design can meet the shower requirements of most people with a simple and ingenious structure and good operability.

2) With the water outlet tube, which is connected to the top shower, extending in an upward inclined direction, no matter how the angle between the top shower and the valve seat assembly is adjusted, the angle between the top shower and the valve seat assembly can meet the needs of users.

BRIEF DESCRIPTION OF THE DRAWINGS

The accompanying drawings described below are used to facilitate further understanding of the present disclosure and constitute a part of the present disclosure. The exemplary embodiments of the present disclosure and their descriptions are used to clarify the present disclosure and should not be improperly understood as any limit to the present disclosure.

Figure 1:
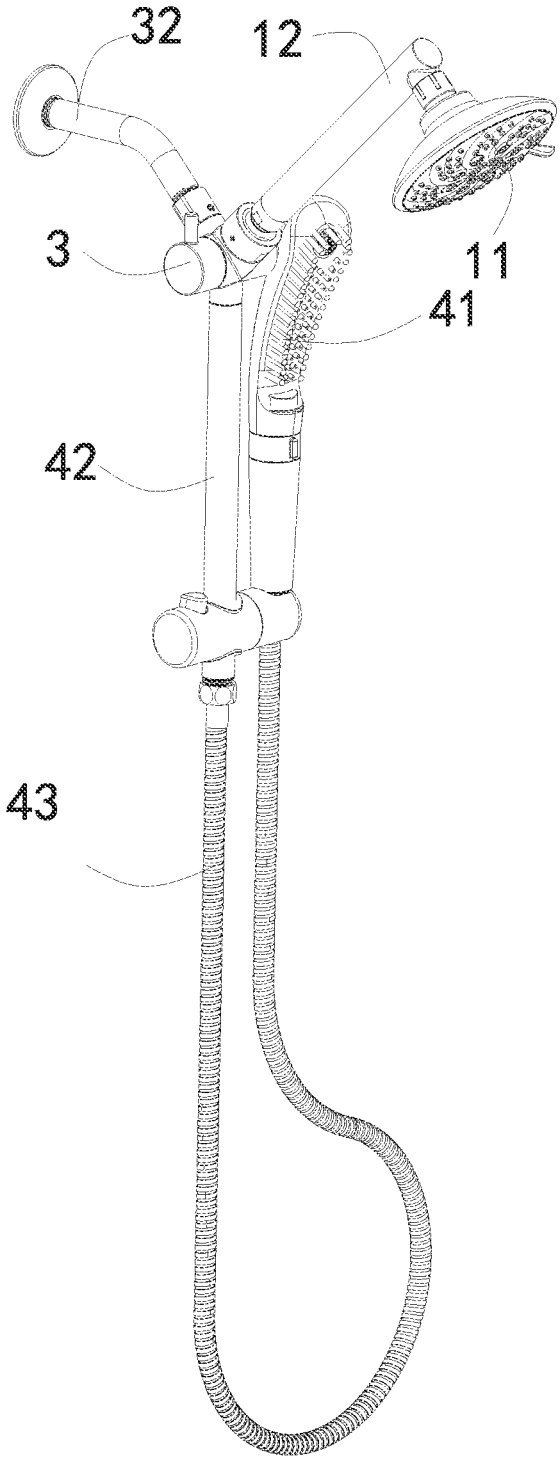
FIG. 1 is an axonometric drawing of a tube support assembly capable of arbitrary adjustment according to the present disclosure.

Reference numerals in the drawings are listed below:

11—top shower; 12—second water outlet tube;
21—steering head; 22—sealing component; 23—nut;
3—valve seat assembly; 31—rotation cavity; 32—water inlet tube;
41—hand shower; 42—first water outlet tube; 43—hose.

DETAILED DESCRIPTION OF THE EMBODIMENTS

In order to clarify the technical problem, technical solution and advantages of the present disclosure, the present disclosure will be further described in detail below with reference to the accompanying drawings and embodiments. It should be understood that the specific embodiments described below are merely intended to explain the present disclosure rather than limit the scope of the present disclosure.

Figure 2:
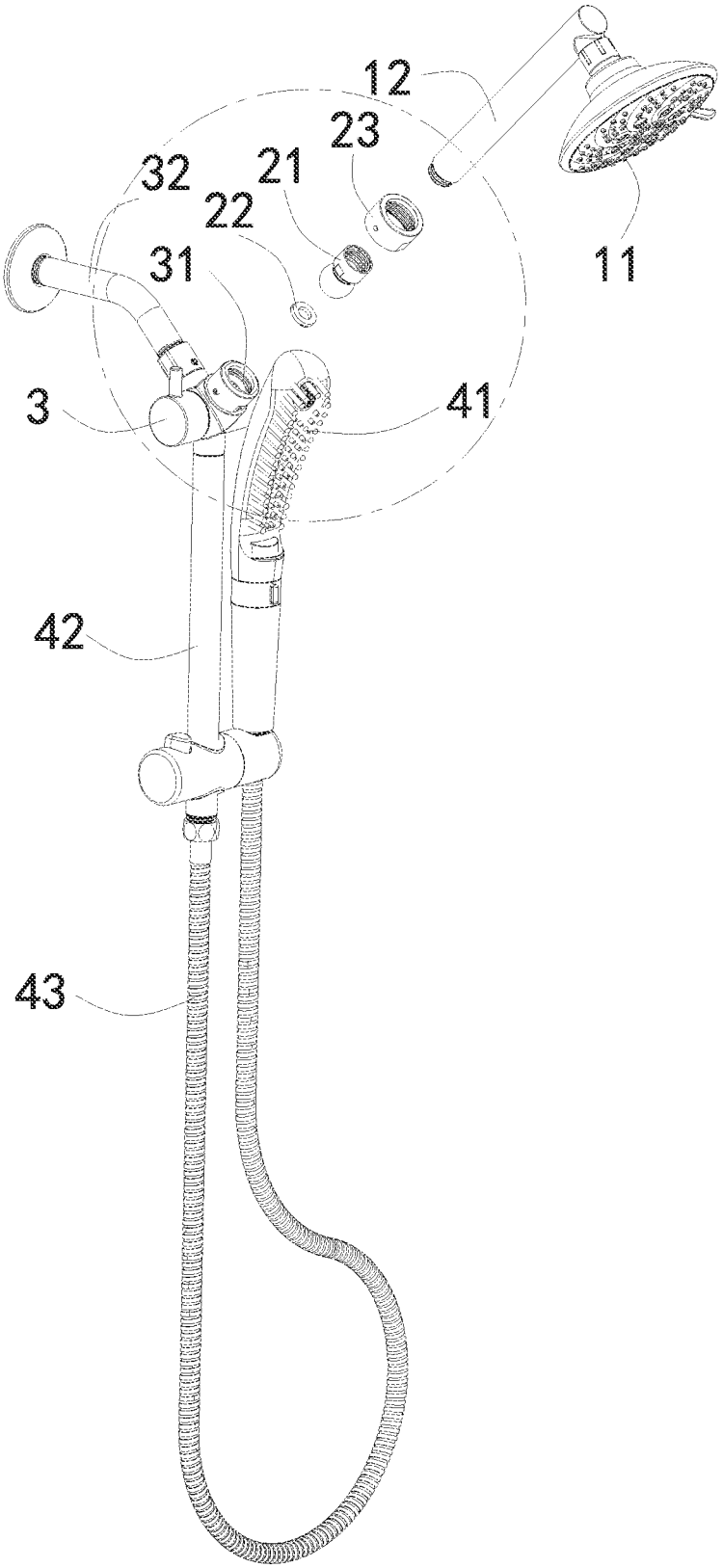
FIG. 2 is an exploded view of the tube support assembly capable of arbitrary adjustment according to the present disclosure.
Figure 3:
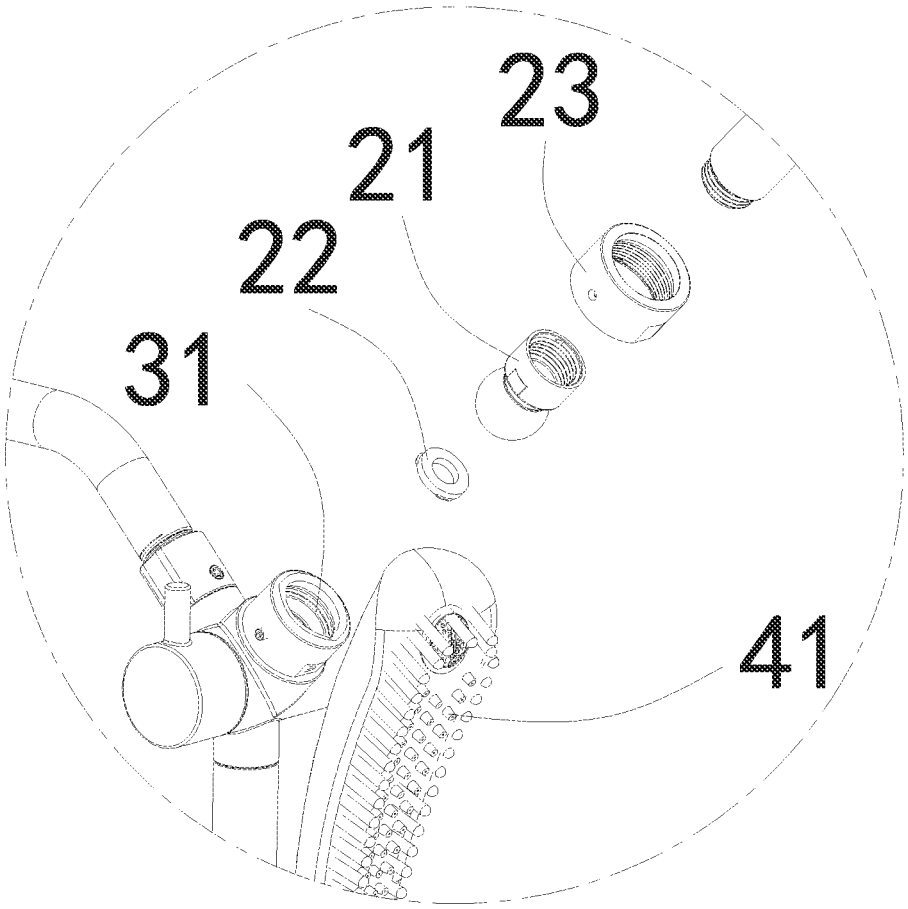
FIG. 3 is a partially enlarged view of FIG. 2.

FIG. 1 and FIG. 2 show a tube support assembly capable of arbitrary adjustment according to a preferred embodiment of the present disclosure. The tube support assembly capable of arbitrary adjustment includes a valve seat assembly 3, a first water outlet tube 42, a second water outlet tube 12 and a water inlet tube 32. The first water outlet tube 42, second water outlet tube 12 and water inlet tube 32 are connected to the valve seat assembly 3. Water enters the water inlet tube 32 and flows to the valve seat assembly 3. The valve seat assembly 3 is switchable to selectively connect the water inlet tube 32 with the first water outlet tube 42 or the second water outlet tube 12 for water outflow. The first water outlet tube 42 is successively connected to the hose 43 and the hand shower 41, the second water outlet tube 12 is connected to the top shower 11, and the water inlet tube 32 is connected to the water supply.

The valve seat assembly 3 has a water inlet and at least two water outlets. The water inlet is connected to the water inlet tube 32. According to the present embodiment, the valve seat assembly 3 has two water outlets including a first water outlet and a second water outlet. The first water outlet is connected to the first water outlet tube 42, and the second water outlet is connected to the second water outlet tube 12.

According to the present embodiment, a central axis of the first water outlet extends in the same direction of a central axis of the tube support assembly of the present disclosure, and the central axis of the first water outlet is oriented downward.

According to the present embodiment, the central axis of the first water outlet and the central axis of the second water outlet form an angle, and the angle formed between the central axis of the first water outlet and the central axis of the second water outlet is an obtuse angle. Namely, the central axis of the second water outlet extends in an upward inclined direction, so as to ensure that when the second water outlet tube 12 drives the top shower 11 to rotate at any angle or in any direction, the top shower 11 can keep spraying downward, but spraying toward the wall after being installed on the wall.

In order to ensure that the second water outlet tube 12 can rotate at any angle and in any direction relative to the valve seat assembly 3, the second water outlet is provided with a steering structure, and the steering structure ensures that the second water outlet tube 12 can be rotated at any angle and in any direction.

The steering structure includes a rotation cavity 31 arranged in the water outlet, a steering head 21 arranged in the rotation cavity 31, and a nut 23 covering and connected to the steeling head 21. The nut 23 fixes the steering head 21 in the rotation cavity 31 while allowing the steering head to move. In this embodiment, the rotation cavity 31 is provided on the second water outlet.

The rotation cavity 31 is provided with a spherical arc surface, and a first end of the steering head 21 close to the rotation cavity 31 is provided with a spherical head. The spherical head is accommodated in the spherical arc surface to enable the steering head 12 to be adjusted at any angle or in any direction relative to the rotation cavity 31. A second end of the steering head 21 away from the rotation cavity 31 is provided with a connection part. The connection part is connected to a first end of the second water outlet tube 12, and a second end of the second water outlet tube 12 is connected to the top shower 11. The second water outlet tube 12 causes the top shower 11 to rotate at any angle and/or in any direction relative to the valve seat assembly 3. A sealing component 22 is provided between the spherical head and the spherical arc surface. The sealing component 22 prevents the water flow passing through the spherical arc surface and flowing to the spherical head from leaking out. In this embodiment, the sealing component 22 may be a special-shaped sealing component.

The working principle of the present disclosure is briefly described as follows.

The water flow enters the valve seat assembly 3 from the water inlet tube 32. The valve seat assembly 3 is switchable to selectively connect the valve seat assembly 3 with the first water outlet tube 42 or the second water outlet tube 12. When the valve seat assembly 3 communicates with the first water outlet tube 42, water flows from the water inlet tube 32 to the valve seat assembly 3, the first water outlet, and the first water outlet tube 42, then successively flows to the hose 43 and the hand shower 41 to be finally sprayed out. When the valve seat assembly 3 communicates with the second water outlet tube 12, water flows from the water inlet tube 32 to the valve seat assembly 3, the second water outlet, and the second water outlet tube 12, then flows to the top shower to be finally sprayed out. When the user taking a shower needs to adjust the spray direction and spray angle of the top shower 11, the top shower 11 can be manually tilted. The spherical head of the steering structure is convenient for the rotation cavity 31 of the steering structure to work under relative rotation, so that the top shower can be adjusted at any angle or in any direction to meet the varying needs of different users.

According to the present disclosure, the water outlet connected to the top shower 11 is provided with a steering structure, so that the top shower 11 and the support tube connected to the top shower can be rotated at any angle and in any direction relative to the valve seat assembly 3. Such humanized design can meet the shower requirements of most people with a simple and ingenious structure and good operability. With the water outlet tube, which is connected to the top shower 11, extending in an upward inclined direction, no matter how the angle between the top shower 11 and the valve seat assembly 3 is adjusted, the angle between the top shower 11 and the valve seat assembly 3 can meet the needs of users.

The foregoing description illustrates the preferred embodiments of the present disclosure. As previously mentioned, it should be understood that the present disclosure is not limited to the forms disclosed herein, and the description of selected embodiments should not be regarded as an exclusion of other embodiments. The selected embodiments may be used in other combinations, modifications and environments, and may be modified within the scope of the inventive concept described herein based on the above teachings or skill or knowledge in the relevant fields. However, such modifications and changes made by those skilled in the art without departing from the spirit and scope of the present disclosure all fall within the scope of the present disclosure as claimed in the claims.

What is claimed is:

1. A tube support assembly capable of arbitrary adjustment, comprising:

a valve seat assembly, wherein the valve seat assembly has a water inlet and at least two water outlets including a first water outlet and a second water outlet, the water outlets are respectively connected to a water outlet component, a central axis of the first water outlet and the central axis of the second water outlet form an obtuse angle, and the valve seat assembly is switchable to selectively connect the the water inlet with any of the water outlet component;

wherein, the first water outlet is provided with a steering structure, the steering structure comprises a rotation cavity provided in the first water outlet, a steering head provided in the rotation cavity, and a nut covered and connected to the steering head, wherein the rotation cavity is provided with a spherical arc surface, an end of the steering head close to the rotation cavity is provided with a spherical head, the spherical head is accommodated in the spherical arc surface, the nut fixes the steering head in the rotation cavity while ensures that the steering head is movable, and the steering head can be adjusted at any angle and/or in any direction relative to the rotation cavity;

a sealing component is provided between the spherical head and the spherical arc surface, the sealing component prevents a water flow passing through the spherical arc surface and flowing to the spherical head from leaking out; and wherein an end of the steering head away from the rotation cavity is provided with a connection part, the connection part is connected to a first end of a second water outlet tube, a second end of the second water outlet tube is connected to a top shower head, the second water outlet tube is a rigid tube, and the second water outlet tube causes the top shower head to be rotated at any angle and/or in any direction relative to the valve seat assembly.

2. The tube support assembly capable of arbitrary adjustment according to claim 1, wherein a central axis of the rotation cavity and a central axis of the tube support assembly extend in an upward inclined direction.

3. The tube support assembly capable of arbitrary adjustment according to claim 1, wherein the central axis of the second water outlet extends in the same direction of the central axis of the tube support assembly.

4. The tube support assembly capable of arbitrary adjustment according to claim 3, wherein the first water outlet is connected to the steering head, the second water outlet is downwardly connected to a first end of a first water outlet tube, and a second end of the first water outlet tube is successively connected to a hose and a hand shower.

5. The tube support assembly capable of arbitrary adjustment according to claim 1, wherein the water inlet of the valve seat assembly is connected to a water inlet tube, and the water inlet tube is connected to a water supply.

* * * * *